US005474347A

United States Patent [19]

Vigneault et al.

[11] Patent Number: 5,474,347

[45] Date of Patent: Dec. 12, 1995

[54] DOOR FRAME REINFORCING PLATE FOR LOCK STRIKER

[76] Inventors: Rémi Vigneault, 2500 Avenue Pierre-Dupuis, Montreal, Quebec, Canada, H3C 4L1; Guy Barre, 250 Beaconsfield Blvd., Beaconsfield, Quebec, Canada, H9W 4A5

[21] Appl. No.: 160,742

[22] Filed: Dec. 3, 1993

[30] Foreign Application Priority Data

Aug. 13, 1993 [CA] Canada ..... 2104033

[51] Int. Cl.[6] ..... E05B 17/00

[52] U.S. Cl. ..... 292/340; 292/346; 49/460; 49/504; 52/514

[58] Field of Search ..... 292/340, 346; 49/462, 460, 504; 52/514

[56] References Cited

U.S. PATENT DOCUMENTS

| | | | |
|---|---|---|---|
| 2,127,891 | 8/1938 | Starling | 292/346 |
| 2,692,158 | 10/1954 | Tirschel | 292/346 |
| 2,795,452 | 6/1957 | Schamel | 292/340 |
| 4,017,106 | 4/1977 | Salazar | 292/340 |
| 4,057,275 | 11/1977 | La Beaud | 292/340 |
| 4,369,994 | 1/1983 | Vorves | 292/340 |
| 4,629,231 | 12/1986 | Bouchard | 292/340 |
| 4,635,399 | 1/1987 | Gehrke et al. | 49/460 |
| 4,684,160 | 8/1987 | Nelson | 292/340 |
| 4,770,452 | 9/1988 | Petree, Jr. | 292/340 |
| 4,802,701 | 2/1989 | Mazie | 292/340 |
| 4,854,621 | 8/1989 | Baldwin | 292/340 |
| 4,865,370 | 9/1989 | Francis | 292/340 |
| 5,003,727 | 4/1991 | Watten | 292/346 |
| 5,070,650 | 12/1991 | Anderson | 292/340 |
| 5,094,489 | 3/1992 | Jones | 292/340 |
| 5,241,790 | 9/1993 | Schimpf | 49/504 |

*Primary Examiner*—Darnell M. Boucher
*Attorney, Agent, or Firm*—Swabey Ogilvy Renault; Guy J. Houle

[57] ABSTRACT

A door frame reinforcing plate used for reinforcing a door frame adjacent a lock striker. The reinforcing plate is comprised of a flat plate section adapted to be secured over an interior flat surface of the frame adjacent the lock striker. The flat plate section has a lock bolt opening therein adjacent a first end of the plate section where the plate is bent at right angle to form a flange to overlie an edge surface portion of the door frame. A plurality of holes are provided in the plate above and below the opening for receiving connecting screws which secure the lock striker. A further series of holes is provided in the plate section to receive fasteners which are secured to the frame from an exterior surface of the frame. The reinforcing plate is not visible from outside the door frame, as it is concealed behind the door frame and behind the usual frame moldings.

7 Claims, 2 Drawing Sheets

DOOR FRAME REINFORCING PLATE FOR LOCK STRIKER

TECHNICAL FIELD

The present invention relates to a door frame reinforcing plate for reinforcing the door frame adjacent a lock striker to prevent forced entry by breaking the frame in the weakened area of the lock striker, and further wherein the reinforcing plate is not visible exteriorly of the door frame.

BACKGROUND ART

Various devices have been heretofore provided to prevent forced entry through a door, such as by breaking the lock of the door or the door frame in the area of the striker plate. Such devices usually comprise securing a metal plate on the door where the locks are installed. Another improvement has been to make the door keepers much stronger. However, when these keepers are installed within the door frame it is necessary to install them close to an outer edge of the frame where the door is received, and this weakens the frame in the outer edge area adjacent the lock striker. When a burglar breaks the door by forced entry, it is usually the frame that breaks in the area of the lock striker.

SUMMARY OF THE INVENTION

It is therefore a feature of the present invention to provide a door frame reinforcing plate which is adapted to reinforce the door frame adjacent a lock striker, and which reinforcing plate is not visible exteriorly of the door frame.

Another feature of the present invention is to provide a door frame reinforcing plate which is easy to install and which is self-attaching to an inside surface of the door frame when secured to the frame.

Another feature of the present invention is to provide a door frame reinforcing plate which is adapted to reinforce door frames of different widths in the area adjacent a lock striker to reinforce the frame to make it many times stronger in the lock striker area to substantially prevent forced entry by breaking the door frame in that area.

According to the above features, from a broad aspect, the present invention provides a reinforced door frame assembly comprising a wooden door frame having a lock striker connected to an exterior surface thereof. A reinforcing flat metal plate is adapted to be secured over an interior flat surface of the door frame adjacent the lock striker by positioning the plate in alignment with the lock striker in a space defined behind said frame. The flat metal plate has a striker bolt aperture therein adjacent a first end of the plate. Striker connecting means is disposed on opposed top and bottom sides of the aperture. One or more groups of holes are disposed in a pattern in the flat plate spaced to a side of the opening opposite the first end for receiving one or more fasteners threaded into the frame from the exterior surface of the frame at a predetermined location. The reinforcing plate has a right-angle flange formed integral at the first end adjacent the opening. The flange is adapted to overlie an edge surface of the door frame. A template permits the alignment of the reinforcing plate with the lock striker and the identification of the predetermined location where the one or more fasteners are to be introduced into the frame whereby the one or more fasteners will engage with a respective hole in the one or more groups of holes when threaded into the frame and cause the reinforcing plate to be secured against the interior flat surface of the frame.

BRIEF DESCRIPTION OF DRAWINGS

A preferred embodiment of the present invention will now be described with reference to the accompanying drawings, in which.

DESCRIPTION OF PREFERRED EMBODIMENTS

Figure 1:
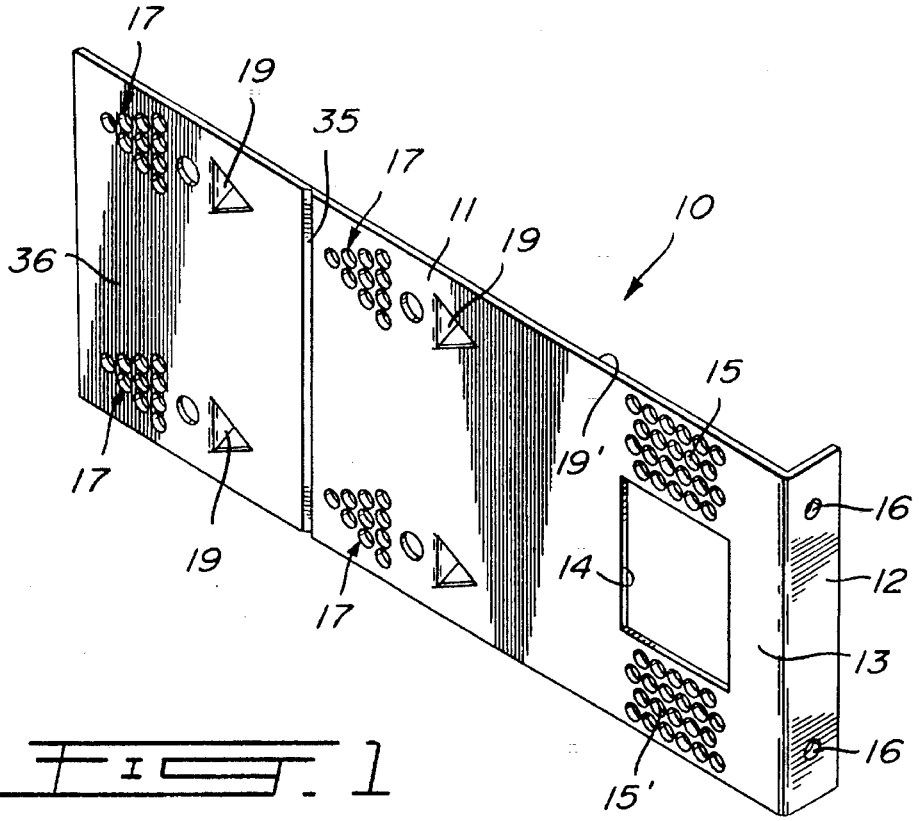
FIG. 1 is a perspective view of the door frame reinforcing plate of the present invention.

Referring now to the drawings, and more particularly to FIG. 1, there is shown generally at 10 the door frame rectangular reinforcing steel plate of the present invention. The reinforcing plate is formed from a steel plate and bent to provide a flat plate section 11 and a right-angle reinforcing end flange 12 formed adjacent an end 13 of the flat plate section. A square opening 14 is provided adjacent the end 13 and constitutes a striker bolt aperture means. A group of holes 15 and 15' is provided above and below the opening 14 for receiving a fastener, herein the striker securing fasteners 18', respectively, in one of the holes in each of the groups 15 and 15', as will be described later. Fastener receiving holes 16 are also provided in the reinforcing flange 12 for further securement of the reinforcing plate to the edge of the door frame, as will be described later.

A further plurality of groups of holes form plate attachment means, as shown by reference numerals 17. These holes receive further fasteners 18 (see FIG. 2) which extend through the door frame 20, as will be described later. Connectors in the form of prongs 19 are punched out of the flat plate section 11 and extend from an interior surface 19' of the plate 10 in the direction of the reinforcing flange 12 to secure the plate to an inner surface 25 of the door frame, as will be described later.

Figure 2:
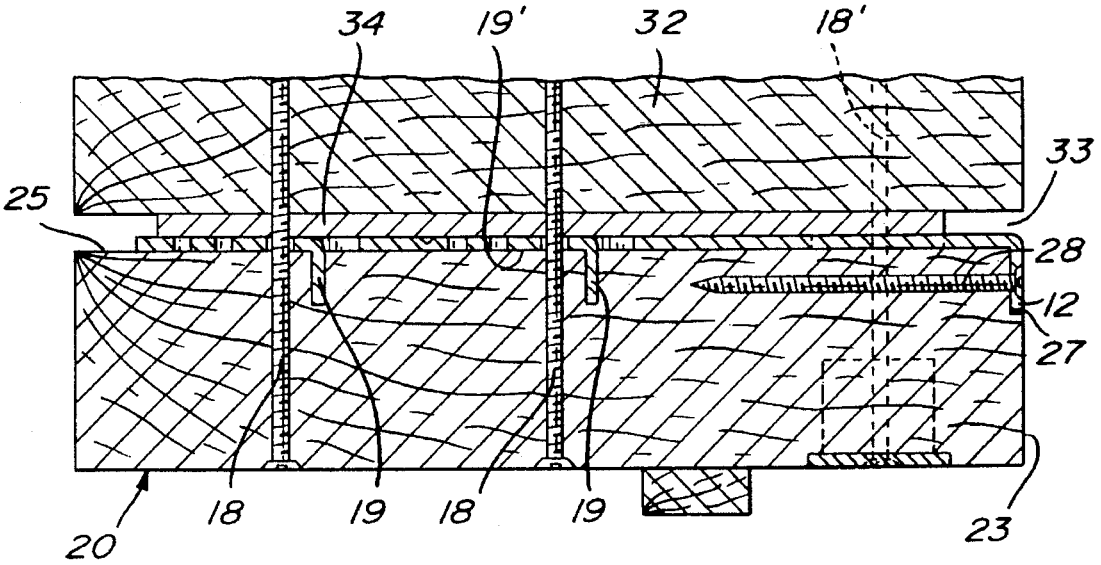
FIG. 2 is a section view illustrating the reinforcing plate connected to a door frame.
Figure 3:
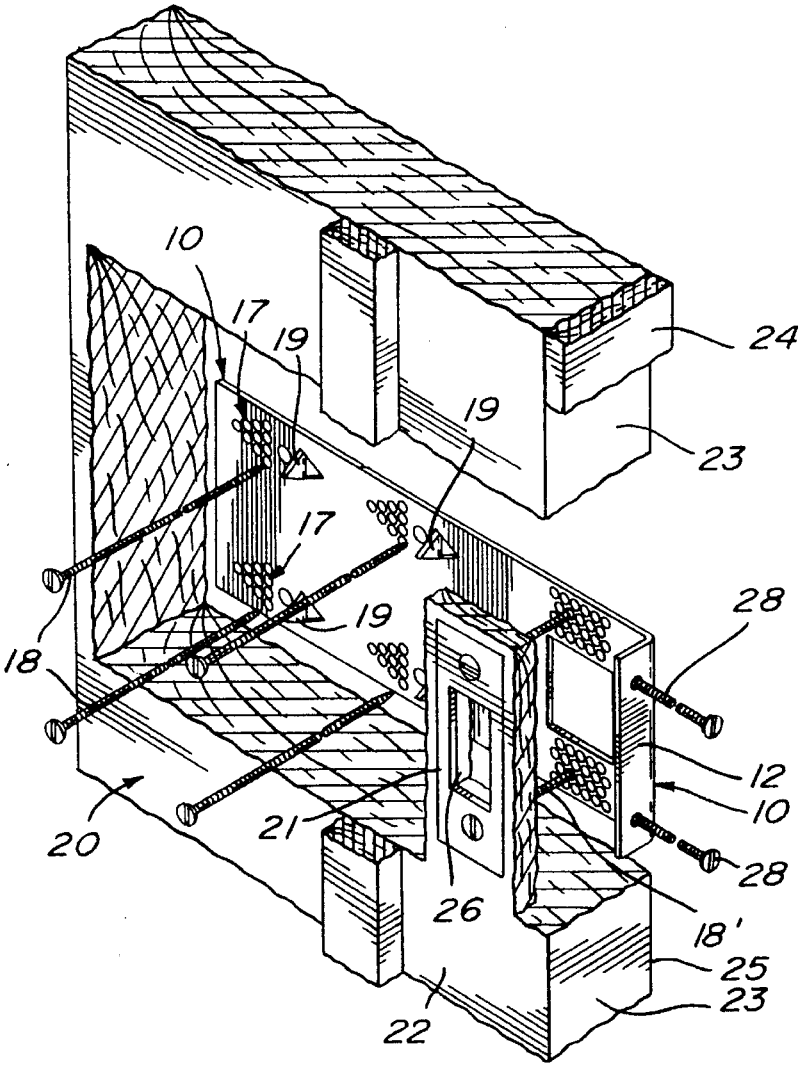
FIG. 3 is a fragmented perspective view showing the location of the reinforcing plate relative to the door frame when secured thereto.
Figure 4:
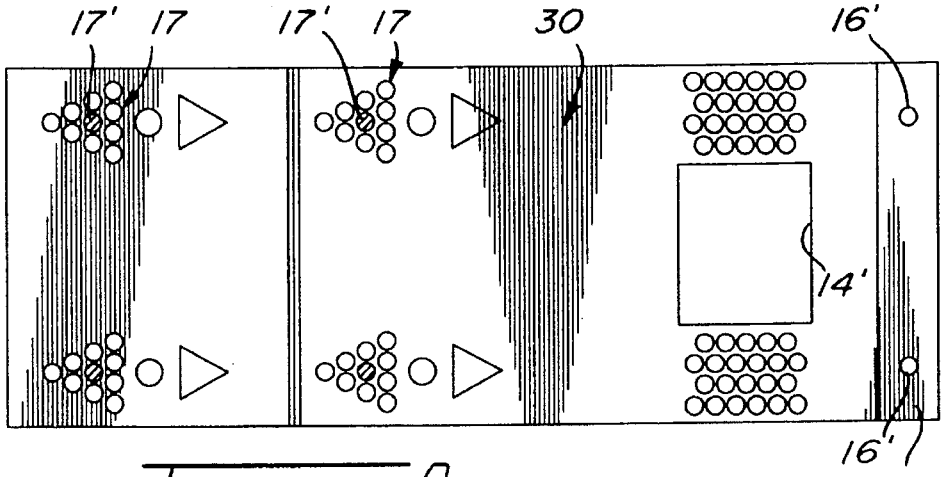
FIG. 4 is a plan view of the template utilized to locate the reinforcing plate and fasteners in position on an interior flat surface of the door frame.

Referring now additionally to FIGS. 2 to 4, there will be described the manner in which the reinforcing plate 10 is secured to the door frame 20. As shown in FIG. 3, the door frame 20 is provided with a striker plate 21 secured to an exterior surface 22 in a door receiving area delineated by a molding 22' spaced from the outer edge wall 23, a distance to accommodate the width of a door (not shown). A molding 24 usually conceals most of the end edge 23. In order to secure the reinforcing plate 10 to the interior surface 25 of the door frame 20, it is firstly necessary to remove he door molding 24 from the end edge wall 23 of the frame where the striker plate 21 is secured. The striker plate 21 is also removed and the template 30, as shown in FIG. 4, is taped on to the door frame with the square 14' in the template aligned substantially centrally with the striker plate hole 26 made in the exterior surface 22. The central hole, or any one of the holes 17 in the group of holes 17, is then punctured by a pencil lead, or a pin or nail, to make a mark on the door frame outer surface. The flange portion 31 of the template is positioned on the frame adjacent the inner surface 25 thereof, and the location of the flange template holes 16' is marked thereon. The end edge 23 of the frame may then be chiseled out to form a cavity 27 to accommodate the reinforcing flange 12 of the plate 10 when extending from the interior surface 25 of the frame 20, as shown in FIG. 2.

As can be seen in FIG. 2, the door frame 20, when secured in a wall, is usually spaced from the wall stud 32 which delineates the door frame opening so that the door frame 20 may be adjusted square within the door frame opening. This forms a gap 33 between the stud 32 and the door frame 20. Pieces of shim 34 are usually squeezed or forced between the frame 20 and the wall stud 32 at spaced intervals therealong to solidify the door frame in square alignment. The reinforcing plate 10 is inserted within this gap 33, as shown in FIGS. 1, 2 and 3, with the reinforcing flange 12 fitted in the chiseled cavity 27 formed in the end edge wall 23 of the door frame. In this position the striker plate flat section 11 is maintained spaced from the interior surface 25 of the door frame by the prongs 19. However, it is possible to secure the right-angle reinforcing flange 12 within the cavity 27 by means of fastening screws 28. Long fastening screws 18 are then drilled into the door frame at the positions 17' identified by the template 30, which has been removed, and these fasteners 18 engage with one of the holes in the groups of holes 17. If the screw is slightly off the mark identified by the central hole 17', it will engage with other holes in the group of holes 17 which surround the central holes 17'. When these screws 18 are secured they urge the flat plate section 11 against the interior surface 25 of the door frame causing the prongs 19 to penetrate within the surface 25 and retain the plate secured thereto from behind the door frame, regardless if the fasteners 18 and 28 are removed. The striker plate 21 is then secured back into position but with longer screw fasteners 16, as better illustrated in FIG. 2, which engage within one of the holes in the group of holes 15 and 15' above and below the opening 14 of the striker plate. The opening 14 provides for the passage of a lock bolt (not shown) should the frame 20 be very small in thickness or should the bolt penetrate a long distance within the keeper hole 26.

After installation of the reinforcing plate 10, the molding 24 is then reinstalled to conceal the striker plate right-angle reinforcing flange 12. Accordingly, from the exterior of the door frame, as illustrated in FIG. 3, the reinforcing plate 10 is concealed and not visible to a burglar. Because the reinforcing plate 10 extends along the frame where the striker plate is installed, and also because the striker plate is connected thereto through the long fasteners 18', the frame becomes extremely strong in that area and makes it very difficult, if not impossible, to break the frame in the keeper area when a force is applied to the door and keeper. Even if the door frame 24 is removed by a burglar and the screws 28 are removed from the reinforcing plate 12, this will not weaken the reinforcing plate and will not alter the reinforcement of the door frame in this area, as the plate is rigidly secured in position by the other screws 18 and 18' which are only visible when the door is open, and the prongs 19 of the plate are embedded within the interior surface 25 of the door frame, and these are not accessible even if the door is open. The reinforcing flange 12 also extends inwardly towards the exterior surface 22 of the door frame and hinders a burglar trying to pry the keeper plate loose by wedging a knife or screw driver behind the door frame.

It can be seen that another advantage of the reinforcing plate of the present invention is that it is very easy to install and no special skills or tools are required for this. The flat plate section 11 is also provided with a transverse groove 35 to define a severable end section 36 of the plate which is easily broken off to shorten the reinforcing plate to accommodate door frames of narrower widths.

It is within the ambit of the present invention to cover other obvious modifications of the reinforcing plate described herein, provided such modifications fall within the scope of the appended claims.

We claim:

1. A reinforced door frame assembly comprising in combination a wooden door frame having a lock striker connected to an exterior surface thereof, a reinforcing flat metal plate adapted to be secured over an interior flat surface of said door frame adjacent said lock striker by positioning said plate in alignment with said lock striker in a space behind said frame, said flat metal plate having a striker bolt aperture therein adjacent a first end of said plate, striker connecting means disposed on opposed top and bottom sides of said aperture, at least one group of holes disposed in a predetermined pattern at predetermined locations in said flat plate spaced to a lateral side of said opening opposite said first end for receiving a fastener threaded into said frame from said exterior surface of said frame at one or more predetermined locations, said reinforcing plate having a right-angle flange formed integral at said first end adjacent said opening, said flange being adapted to overlie an edge surface portion of said door frame a template permitting the alignment of said reinforcing plate with said lock striker and the identification of said predetermined locations as well as the disposition of holes in said at least one group of holes where said fastener is to be introduced into said frame whereby said fastener will engage with one of said holes of an associated group of holes when threaded into said frame and cause said reinforcing plate to be secured against said interior flat surface of said frame.

2. A reinforced door frame assembly as claimed in claim 1 wherein said striker bolt aperture is an opening in said plate, said striker connecting means comprising a plurality of holes disposed in a pattern adjacent a top and bottom end of said opening for receiving in connecting engagement, in one of said holes, a fastener securing the striker and aligned respectively with the top and bottom of said opening.

3. A reinforced door frame assembly as claimed in claim 1 wherein said flat metal plate is further provided in an interior face thereof with connectors for engagement into the interior flat surface of said door frame when urged thereagainst by said fasteners engaging one of said groups of holes from an exterior surface of said door frame.

4. A reinforced door frame assembly as claimed in claim 3 wherein said connectors are prongs which are punched in said flat section, said prongs having a pointed end and extending at substantially right angles from said interior face of said flat plate section.

5. A reinforced door frame assembly as claimed in claim 1 wherein said plate is an elongated rectangular steel plate.

6. A reinforced door frame assembly as claimed in claim 5 wherein said flat metal plate is provided with a transverse groove to define, in an end section opposite said first end, a break-off section to accommodate door frames of narrower widths.

7. A reinforced door frame assembly as claimed in claim 1 wherein said flange is provided with one or more fastener receiving holes therein.

* * * * *